United States Patent [19]

Miszkwitz, Jr.

[11] 4,081,154

[45] Mar. 28, 1978

[54] YARN DISPENSER

[76] Inventor: Anthony W. Miszkwitz, Jr., 21745 Hwy. 18, Apple Valley, Calif. 92307

[21] Appl. No.: 678,681

[22] Filed: Apr. 21, 1976

[51] Int. Cl.[2] ..... B65H 49/00

[52] U.S. Cl. ..... 242/129.8; 242/137.1

[58] Field of Search ..... 242/137, 137.1, 138, 242/141, 146, 129.8; 206/150, 389, 392; 225/46–48, 33, 59–63

[56] References Cited

U.S. PATENT DOCUMENTS

| | | | |
|---|---|---|---|
| 924,091 | 6/1909 | Moss | 242/137.1 |
| 3,352,412 | 11/1967 | Draving et al. | 206/150 |
| 3,480,190 | 11/1969 | Freedman | 225/33 |
| 3,586,162 | 6/1971 | Townsend | 206/150 |

*Primary Examiner*—Leonard D. Christian

*Attorney, Agent, or Firm*—William H. Maxwell

[57] ABSTRACT

A packaging for yarn and the like, characterized by a dispenser comprised of a transparent housing in which a supply of yarn is wound onto a bobbinlike pin and confined by said housing to preclude entanglement, the yarn being withdrawn axially from the bobbin supply and frictionally embraced by members that form the housing and closure therefor, whereby the yarn is visible for selective withdrawal in lengths as circumstances require.

7 Claims, 4 Drawing Figures

YARN DISPENSER

BACKGROUND

This invention is concerned with supplying threads such as yarn for use in embroidering, and particularly yarns that are selectively used for this purpose in the ornamental decoration of fabric furnishings and clothing or the like. For example, pants, shirts, dresses, jackets, table cloths and pillow cases and the like are among those articles which are subject to being embroidered; and all of which involves the selection of varied colored and varied lengths of thread. Heretofore, embroidery yarn has been supplied in looped skeins and/or wound upon spools and/or in balls, and all of which are subject to exposures and entanglements and a hindrance to the withdrawal of a certain length thereof and subject to being soiled. Therefore, it is a general object of this invention to provide a dispenser for the storage of and supply of yarn and the like, to maintain it in an optimum condition and ever ready for withdrawal without entanglement.

Spooled thread and thread supplied in skeins are subject to rapid deteriorization, since they are not in any way protected from the surrounding conditions which are often adverse. Sunlight alone can be very damaging over a period of time during storage, or contact with other objects such as to abrade and thereby change the thread texture, or simply to collect dust and to deteriorate by exposure to gases carried into contact therewith by the surrounding atmosphere; all of these and others follow from the lack of protection. Therefore, it is an object to provide an enclosure for the containment of yarns and the like and from which the said yarn is accessible for selective withdrawal.

Packages or boxes are not the answer to storage of colored yarns and threads that are to be selected according to color, and to this end it is an object of this invention to provide a transparent enclosure therefor from which lengths of the yarn and thread can be withdrawn as circumstances require. With the present invention there is a transparent enclosure that protectively houses the thread supply and which completely encloses the supply (not hermetically) and with a strategically positioned dispensing opening that frictionally holds the remaining thread restrained for manual engagement and withdrawal of additional lengths as and when desired.

Spooled and skeined yarns and threads are notoriously subject to snarls and entanglements, and accordingly it is an object of this invention to avoid the same entirely by the dispenser hereinafter disclosed and which issues a length of yarn or thread directly from a bobbin like pin loosely confined within a supply chamber.

Merchandising of multi color yarn, as well as the storage thereof, for selective use is solved by the present invention wherein packaging comprises the aforesaid housing and pin supply combined with a base that provides the enclosure and restraint against accidental removal. In practice, the base is a card that bears identifying indicia, both to identify the same etc. and for aiding selectivity.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
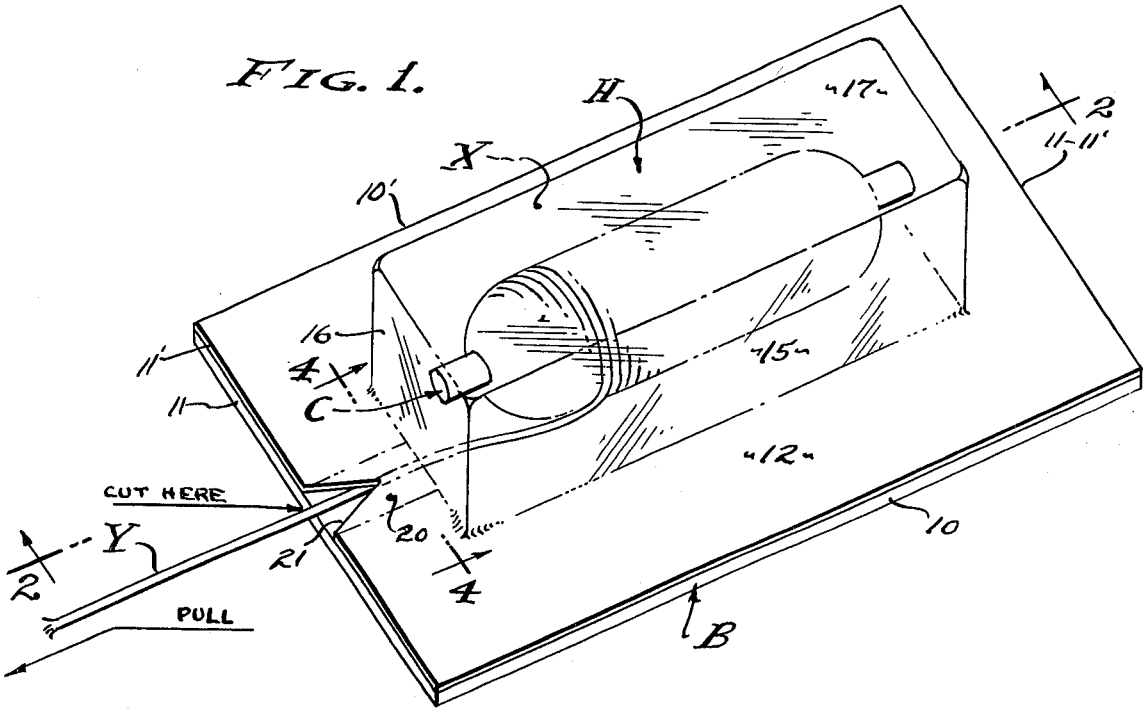
FIG. 1 is a perspective view of the yarn dispenser, illustrating the withdrawal of yarn.
Figure 2:
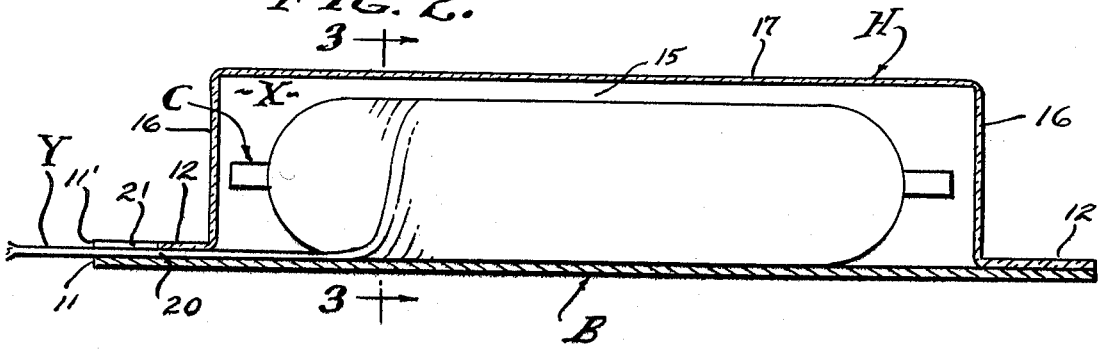
FIG. 2 is a longitudinal sectional view taken as indicated by line 2—2 on FIG. 1.
Figure 3:
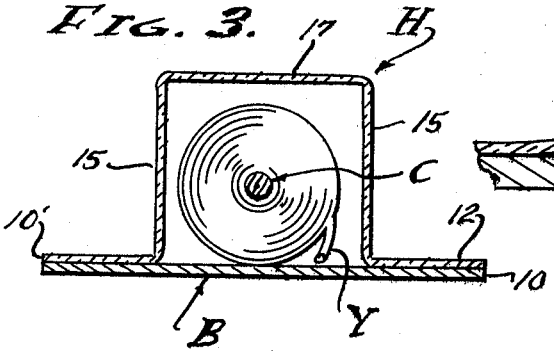
FIG. 3 is a transverse sectional view taken as indicated by line 3—3 on FIG. 2.

The dispenser is adapted especially to the merchandising and selective use of yarns and like threads, whereby a supply thereof is contained within a transparent enclosure ready for manual withdrawal in lengths as circumstances require. In its preferred form, the dispenser is comprised of a base B that provides the support and closure for a transparent housing H that retains a bobbin carrier C for the supply of yarn. A characteristic feature of this invention is the opening between the base and housing and located so as to assure withdrawal without entanglement and frictionally holding the supply of yarn positioned to be severed from a withdrawn length thereof while constraining the remaining supply thereof for subsequent manual withdrawal. In practice, the base B is a stiff member that affords rigidity to the combination, and the transparent housing H is carried thereby and elongated so as to form a chamber of like configuration for the retainment of the bobbin carrier C substantially coextensive in length therewith.

Referring now to the base member B, a relatively stiff and/or rigid card of rectangular planar configuration is employed, of paper or the like. For practical purposes the member B is imperforate with flat top and bottom faces extending between parallel sides 10 and ends 11. Not shown is the indicia and advertisement that can be printed upon the base B, top and bottom, for the purpose of display and with use instruction.

Referring now to the transparent housing member H, a relatively thin wall of plastic material is employed, and preferably a material that can be molded or formed into the box-like configuration shown. Like the base, the member H is also imperforate and preferably such as to coextensively overlie the base member B, with parallel sides and ends 10' and 11' coincidental with the aforementioned sides and ends 10 and 11. The housing is then provided with a marginal portion 12 that is coextensive with the perimeter thereof, for attachment to the base; the housing feature per se being positioned within the said margin 12. Characteristically, the box-like housing is comprised of integral side walls 15, end walls 16 and a top wall 17, that continue one into the other at their adjoined edges. This box-like configuration is of uniform elongated cross section with the sides and top spaced substantially closer than the ends, and to the end that an elongated chamber X is established therein. In carrying out this invention, the spacing of the side walls 15 and top 16 from the base B is approximately the same, so as to establish a uniformly square cross section conducive to reception of a roll of yarn.

Figure 4:
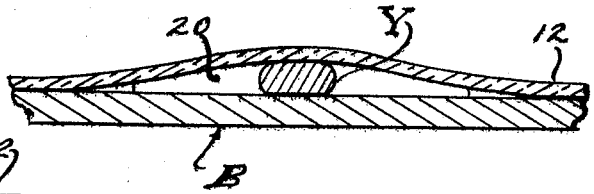
FIG. 4 is an enlarged fragmentary view taken as indicated by line 4—4 on FIG. 1.

The transparent housing H is preferably a vacuum-formed plastic member attached to the base B as by heat sealing or with any suitable adhesive or the like, and/or with mechanical fasteners, and all as circumstances require. However, and in accordance with this invention, the interface engagement of the base member B with the margin 12 of the housing member H is allowed to remain free at the one delivery end thereof, so as to provide an interstice subject to separation and through which the yarn Y is to be withdrawn. It will be seen that there is a passage area 20 established by said separation, to project from the chamber X at the top plane of the base member B and extending to the end edges 11 and 11' of the base and housing respectively. In practice, one or the other member is notched at 21 to facilitate manual engagement of the yarn Y, and preferably the housing member B which normally faces the user. Thus, the yarn Y is frictionally engaged between the members B and H within the area 20 (see FIG. 4) and issues from the edges 11 and 11' while being constrained by the juxtaposed interfaces of said passage area. After withdrawing a length of yarn, it is cut or severed at or along the edges 11 and 11' and a subsequent length is manually engageable by lifting the terminal end portion thereof from the notch at 21.

Referring now to the bobbin carrier C, a rigid stick of spindled configuration is employed and which is substantially as long as but considerably smaller in diameter than the chamber X. In its preferred form, the bobbin carrier is a straight cylinder member of solid formation, or it can be tubular, with its opposite ends terminated in spaced relation to the end walls 16 for complete freedom within chamber X. In accordance with this invention, the yarn to be supplied is spindled onto the bobbin carrier C and distributed in spiraled turns throughout its length and wound thereon to a diameter not to exceed the cross sectional interior of the chamber X. Consequently, the yarn Y as it is wound upon the bobbin carrier C is free to turn within the chamber X, to pay off lengths thereof as they are withdrawn tangentially therefrom. However, the passage area 20 is located axially beyond the terminal end of the bobbin carrier supply of spindled yarn, and to the end that the yarn is withdrawn on a bias as it passes off of the perimeter adjacent to the base member B which forms the closure for housing H.

From the foregoing it will be seen that a highly utilitarian dispenser for yarns and the like is provided, and one that is operable as circumstances require to withdraw suitable lengths of yarn readily selected according to color and without entanglements. The supply of yarn is protectively constrained within the chamber X, and the terminal end portion remains accessible at all times for manual engagement and withdrawal of the yarn through the passage area 20. The bobbin carrier C and its supply of yarn Y wound therein is at all times free within the chamber X, and consequently the loop that initially separates from the spindled winding of yarn is loose as it extends diagonally or on a bias toward its axial alignment disposed through the passage area 20, to be tensioned during withdrawal therethrough. Any suitable cutting instrument can be employed to sever the yarn at or along the edges 11 and 11'.

Having described only a typical preferred form and application of my invention, I do not wish to be limited or restricted to the specific details herein set forth, but wish to reserve to myself any modifications or variations that may appear to those skilled in the art:

I claim:

1. A yarn dispenser including, an elongated housing of uniform cross section comprised of adjoining side and top and end walls forming a chamber, a planar display card closure in cooperation with said housing and comprising the bottom of said chamber, a bobbin carrier spirally wound with the yarn to be dispensed and disposed lengthwise of the chamber within the housing and free of the end walls and with the yarn free to turn within the side and top walls and closure bottom, and a passage area at one side of the housing frictionally engaging the yarn as it extends tangentially from the bobbin carrier to be withdrawn.

2. The yarn dispenser as set forth in claim 1, wherein the housing and closure therefor are juxtapositioned at said one side thereof to present an interface opposition frictionally engaging the yarn.

3. The yarn dispenser as set forth in claim 1, wherein the housing and closure therefor are juxtapositioned adjacent one end wall thereof to present an interface opposition frictionally engaging the yarn.

4. The yarn dispenser as set forth in claim 1, wherein the housing includes a flange and the closure attached thereto with said passage area a juxtapositioned portion of said flange and closure to present an interface opposition frictionally engaging the yarn.

5. The yarn dispenser as set forth in claim 1, wherein the housing includes a flange and the closure attached thereto with said passage area a juxtapositioned portion of said flange and closure and one of which is notched for access to the yarn for withdrawal from interface opposition frictionally engaged within said passage area.

6. The yarn dispenser as set forth in claim 1, wherein the housing and closure therefor are juxtapositioned adjacent one end wall thereof and the housing includes a flange and the closure being attached thereto with said passage area a portion of said flange and closure to present an interface opposition frictionally engaging the yarn.

7. The yarn dispenser as set forth in claim 1, wherein the housing and closure therefor are juxtapositioned adjacent one end wall thereof and the housing includes a flange and the closure being attached thereto with said passage area a portion of said flange and closure and one of which is notched for access to the yarn for withdrawal from interface opposition frictionally engaged within said passage area.

* * * * *